United States Patent [19]

Burch

[11] Patent Number: 4,825,786

[45] Date of Patent: May 2, 1989

[54] SEWING METHOD AND APPARATUS

[76] Inventor: William A. Burch, P.O. Box 1191, Standford, Fla. 32772

[21] Appl. No.: 61,112

[22] Filed: Jun. 12, 1987

[51] Int. Cl.[4] ..... D05B 49/04; D05B 43/00

[52] U.S. Cl. ..... 112/181; 112/241; 112/255; 112/262.1

[58] Field of Search ..... 112/181, 185, 189, 192, 112/242, 243, 255, 262.1, 241

[56] References Cited

U.S. PATENT DOCUMENTS

| | | | |
|---|---|---|---|
| 243,444 | 6/1881 | Gritzner | 112/181 |
| 444,759 | 1/1891 | Leslie | 112/189 |
| 1,022,185 | 4/1912 | Elsden | 112/189 X |
| 2,682,846 | 7/1954 | Bell | 112/181 |

*Primary Examiner*—Wm. Carter Reynolds
*Attorney, Agent, or Firm*—James H. Beusse

[57] ABSTRACT

A method and apparatus for forming stitches with a sewing machine by periodically rewinding needle thread onto its spool as a sewing needle pulls off bobbin thread so as to form tight lock stitches without a take up lever.

14 Claims, 5 Drawing Sheets

FIGURE 4
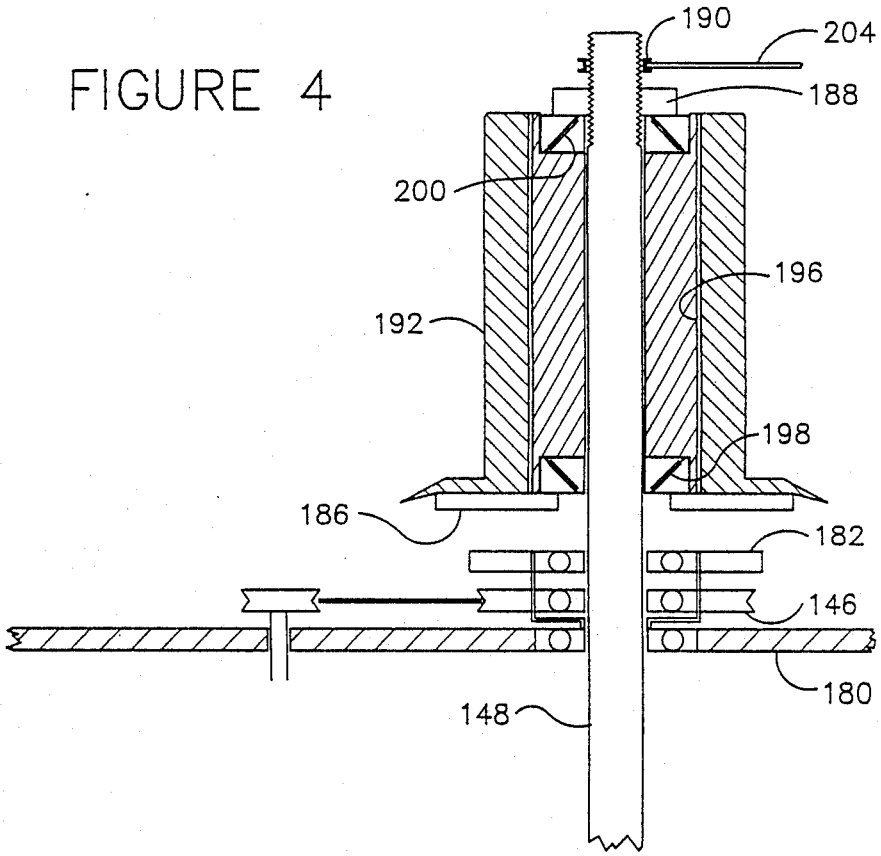
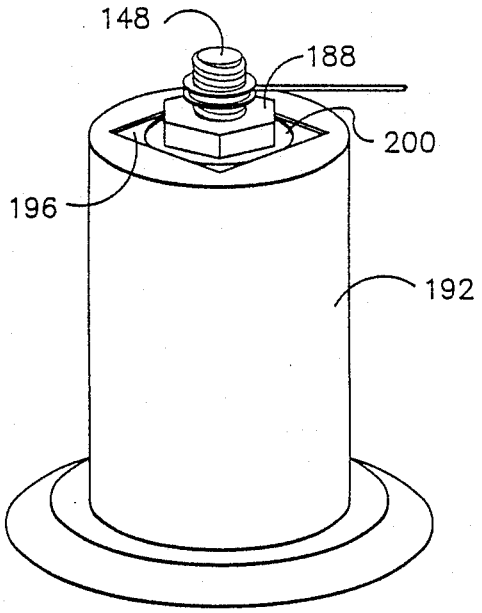
FIGURE 5

SEWING METHOD AND APPARATUS

FIELD OF THE INVENTION

The present invention relates to sewing machines and, more particularly, to a method and apparatus for commercial sewing machines for implementing use of oversize bobbins.

BACKGROUND OF THE INVENTION

In the practice of sewing with machines, a reciprocating needle is driven downwardly to pull thread from a spool and to form a loop beneath the material to be stitched. A bobbin, containing a second supply of thread, is then moved to pass through the loop. The needle is then driven upwardly whereby the needle thread pulls the loop along with the bobbin thread, to form a lock stitch in the material. This sequencing of the needle and the bobbin, along with their threads, is repeated in a continuing cycle of operation to form a line of stitching in the material.

During the sewing operation, the needle thread extends between the spool and the needle, passing through guides, tensioning devices and the eye of a reciprocating take-up lever so as to provide the necessary forces on the needle thread. The tensioning devices provide resistive forces to preclude excessive lengths of thread from being pulled from the spool during the downward movement of the needle. The take-up lever retracts the needle thread as the needle and its thread begin to pull the bobbin thread upwardly to thereby tighten both threads and thus form a tight lock stitch. Proper stitch formation requires precise adjustment of the tensioning devices and proper sequencing of the take-up lever with the movement of the needle and bobbin.

Even when the tensioning devices and take-up lever are properly adjusted and sequenced, limitations are inherent in all known sewing machines. For example, sewing machines traditionally utilize needle thread spools supporting thread of virtually limitless amount. The thread of the bobbin, because no technique has been devised for conveniently retracting a needle loop sufficiently to tighten the stitch-forming threads following passage of an enlarged bobbin through an enlarged loop. Longer take-up levers have been tried to effect the longer needle thread retraction necessitated by the use of enlarged bobbins. Unfortunately, such longer arms induce extraneous vibrations into the machines and thus cause undesirable, irregular stitches. As a result, enlarged bobbins are not used and an operator must, therefore, periodically stop sewing to replenish the thread of smaller bobbins, an inefficient digression from the sewing process.

Various devices have been developed and utilized for controlling the needle thread of sewing machines. U.S. Pat. No. 345,581 to Fleharty; U.S. Pat. No. 1,536,579 to Groebli; and U.S. Pat. No. 3,312,185 to Chezaud et al all relate to controlling needle thread through tensioning devices which are intermittent, variable or braked. In addition, U.S. Pat. No. 2,191,046 to Tiesler and U.S. Pat. No. 2,652,017 to Hohmann relate to take-up levers in combination with tensioning mechanisms for controlling needle threads in manners which are improvements over previously known mechanisms. None, however, is adequate to preclude precise and periodic adjustments and none is adequate to allow the use of enlarged bobbins required for supporting large amounts of thread.

As illustrated by the great number of prior patents, efforts are continuously being made in an attempt to more efficiently and conveniently sew with machines. None of these prior art efforts, however, suggests the present inventive method or combination of elements for sewing with rewound needle thread as disclosed and claimed herein. The devices and methods of the prior disclosures do not provide for the superior, consistent and convenient formation of tight stitches time after time while utilizing enlarged bobbins as with the method and apparatus of the present invention. The present invention achieves its purposes, objectives and advantages over the prior art through new, useful and unobvious apparatus and method steps which consistently and conveniently insure high quality stitches through the use of a minimum number of functioning parts, at a reduction in cost, and through the utilization of only readily available materials and conventional components.

These objects and advantages should be construed as merely illustrative of some of the more prominent features and applications of the present invention. Many other beneficial results can be attained by applying the disclosed invention in a different manner or by modifying the invention within the scope of the disclosure. Accordingly, other objects and advantages as well as a fuller understanding of the invention may be had by referring to the summary of the invention and detailed description of the preferred embodiments of the invention in addition to the scope of the invention as defined by the claims taken in conjunction with the accompanying drawings.

SUMMARY OF THE INVENTION

The present invention is defined by the appended claims with the specific preferred embodiments shown in the attached drawings. For the purposes of summarizing the invention, the invention may be incorporated into a method of forming lock stitches with a sewing machine wherein a reciprocating needle pulls needle thread from its spool and inserts it through the material to be stitched to form a loop of needle thread. A bobbin with bobbin thread is passed through the loop and, thereafter, the needle is withdrawn from the material to pull off bobbin thread from the bobbin for the forming of a lock stitch. The improvement comprises the step of rewinding needle thread onto its spool as the needle pulls off bobbin thread from the bobbin so as to form a tight lock stitch. The rewinding step includes the intermittent frictional coupling of a rotatable wear plate and a continuously rotating drive plate. The frictional coupling is effected by the movement of the wear plate into contact with the drive plate against the force of a coil spring. The rewinding step is done intermittently, in synchronism with the stitch forming movements of the needle and the bobbin. The method further includes the step of initiating the rewinding of the spool after the bobbin has passed through the loop and the needle has begun its ascent. The method further includes the step of terminating the rewinding of the spool prior to the bobbin passing through the loop and the needle beginning its descent.

The invention may also be incorporated into a sewing machine for forming lock stitches, the sewing machine being of the type which comprises a reciprocating needle for pulling thread from its spool and inserting it through the material to be stitched to form a loop of needle thread. The sewing machine also being of the type which comprises a bobbin for supporting a supply of bobbin thread to be passed through the loop and also comprises drive means to withdraw the needle from the material and thereby pull off bobbin thread from the bobbin for the forming of lock stitches. The improvement comprises rewinding means to rewind needle thread onto its spool as the needle pulls off bobbin thread from the bobbin so as to form a tight lock stitch. The rewinding means includes a rotatable wear plate and a continuously rotating drive plate and further includes means to intermittently frictionally couple the wear plate and the drive plate in synchronism with the movement of the needle and the bobbin. The means to frictionally couple the wear plate and the drive plate includes a cylindrical drive rod supporting the spool and coupled to the wear plate for moving the wear plate into contact with the drive plate against the force of a coil spring. The apparatus further includes means to activate the rewinding means intermittently, in synchronism with the stitch forming movements of the needle and the bobbin. The apparatus further includes means to initiate the rewinding means after the bobbin has passed through the loop and the needle has begun its ascent. The apparatus further includes means to terminate the rewinding means prior to the bobbin passing through the loop and the needle beginning its descent.

The invention may further be incorporated into a sewing machine for forming lock stitches from a needle thread and a bobbin thread wherein the sewing machine comprises (1) spool for supporting a supply of needle thread; (2) a needle reciprocable upwardly and downwardly to pull needle thread from the spool and insert it through the material to be stitched when the needle is driven downwardly to thereby form a loop of needle thread; (3) a bobbin for supporting a supply of bobbin thread, the bobbin being movable in a path of travel to pass bobbin thread through the loop; (4) drive means to move the needle and bobbin in synchronism whereby the needle will pull off bobbin thread when the needle is driven upwardly following passage of the bobbin thread through the loop to thereby form a lock stitch; and (5) rewinding means to rewind needle thread onto the spool as the needle is driven upwardly to pull bobbin thread and thereby form a tight lock stitch. The sewing machine also includes a drive rod supporting the spool and a wear plate rotatable with the spool, the rewinding means also including a drive plate continuously rotatable with the drive rod. The rewinding means also includes means to intermittently frictionally coupling the wear plate and the drive plate.

The sewing machine may include bearing means, the inner race of which is received by the drive rod and the outer race of which is secured to the spool whereby the spool may rotate in a first direction to feed needle thread to the needle when the wear plate and the drive plate are out of contact. The sewing machine further includes a tensioning bearing riding on the spool to retard the movement of thread from the spool. The frictional coupling of the wear plate and the drive plate may rotate the spool in a second direction.

The sewing machine may include a spool holder with a cylindrical inner bore slidably received over the drive rod, the spool holder having an outer surface with a rectangular cross sectional configuration for receiving a correspondingly shaped interior surface of the spool for rotation therewith, whereby the spool may rotate in a first direction to feed needle thread to the needle when the wear plate and the drive plate are out of contact. The sewing machine further includes thrust bearing means for frictionally coupling the drive rod to the spool holder. The frictional coupling of the wear plate and the drive plate is sufficient to rotate the spool in a second direction.

The foregoing has outlined rather broadly the more pertinent and important features of the present invention in order that the detailed description of the invention that follows may be better understood whereby the present contribution to the art can be more fully appreciated. Additional features of the invention will be described hereinafter which form the subject of the claims of the present invention. It should be appreciated by those skilled in the art that the conception and the specific embodiments disclosed herein may be readily utilized as a basis for modifying or designing other methods and apparatus for carrying out the same purposes of the present invention. It should also be realized by those skilled in the art that such equivalent methods and apparatus do not depart from the spirit and scope of the invention as set forth in the appended claims.

BRIEF DESCRIPTION OF THE DRAWINGS

For a more complete understanding of the nature, objects and advantages of the present invention, reference should be had to the following detailed description taken in conjunction with the accompanying drawings in which:

FIG. 4 is an enlarged sectional view of the needle thread spool and related mechanisms illustrated in FIG. 3.

FIG. 5 is an enlarged perspective illustration of a spool, spool holder, and related parts which may be used in the embodiments shown in FIGS. 3 and 4.

Similar reference numerals refer to similar parts throughout the several Figures.

DETAILED DESCRIPTION OF THE INVENTION

Figure 1:
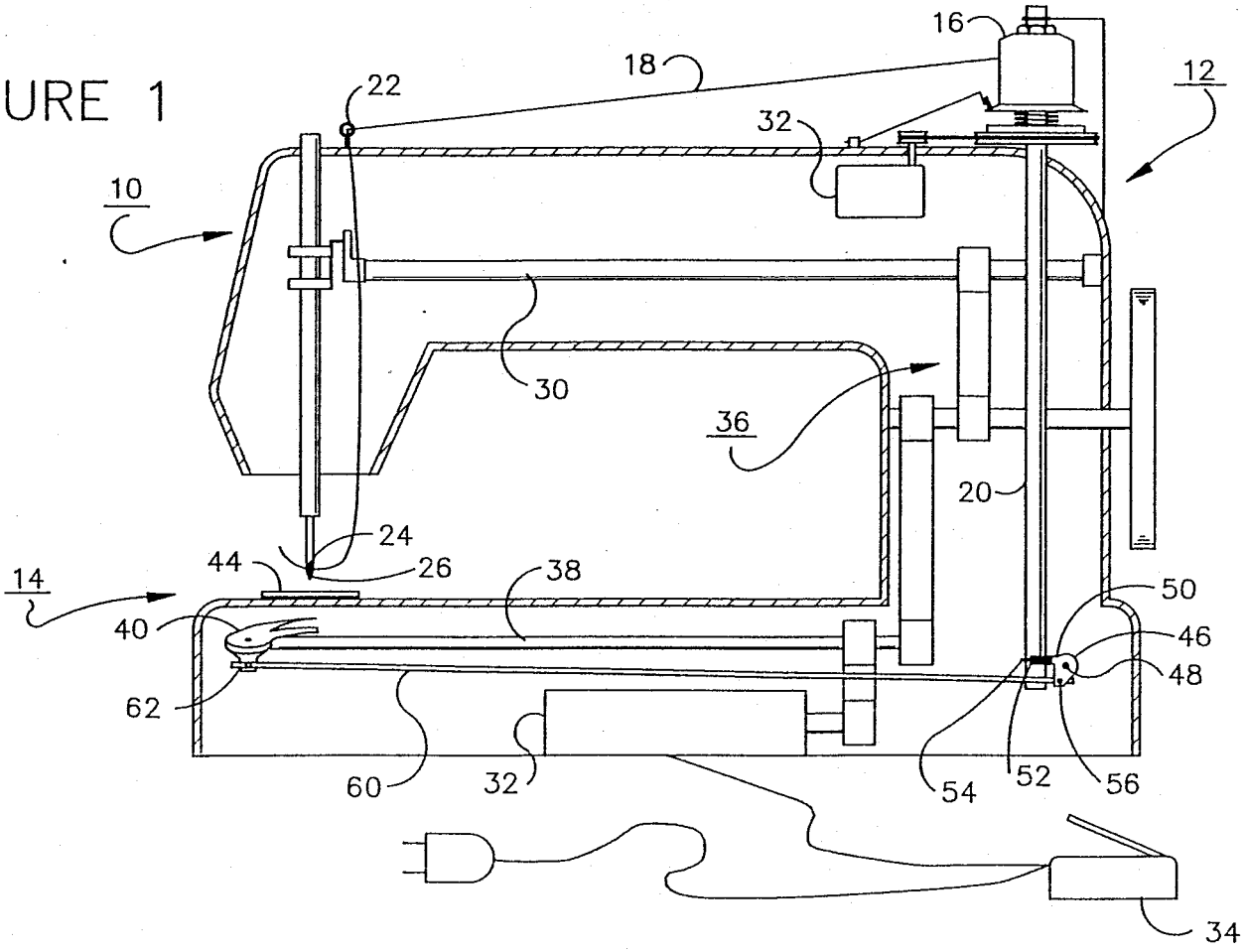
FIG. 1 is a sectional view of a sewing machine constructed in accordance with the principles of the present invention and which is also adapted for carrying out the method of the present invention.

Shown in FIG. 1 is an overview of a sewing machine 10 constructed in accordance with the principles of the present invention. The machine includes a needle thread station 12 and a stitch forming station 14. At the needle thread station, a spool 16 containing the needle thread 18 is supported for rotation on a vertical drive rod 20. The thread is passed through a fixed guide loop 22 directly to the eye 24 of a needle 26 at the stitch forming station. At the stitch forming station, the needle is adapted for vertical reciprocation in the conventional manner through its coupling to the main drive shaft 30. The main drive shaft also moves the other operating mechanisms of the sewing machine in the conventional manner as described, for example, in the above referred to prior art patents. These operations are effected through a motor 32 controlled by an operator depressing a variable speed foot switch 34.

The depression of the foot switch 34 will power the motor 32 to move the drive train 36 including the main drive shaft 30 as well as the secondary drive shaft 38 to move the bobbin 40 along with the needle 26 in their intended paths of motion for forming lock stitches. The bobbin 40 may take any of the conventional forms to oscillate or rotate about an axis either vertical or horizontal. As the needle descends downwardly through the material 44 to be stitched it will pull with it an appropriate length of needle thread from the spool 16. As the needle moves beneath the material and begins its ascent upwardly through the material, it will form a loop of needle thread at a location whereby the hook of the bobbin will penetrate and expand the loop sufficiently for its passage therethrough. The bobbin will also present a length of bobbin thread which had been previously wound on the bobbin. The upward movement of the needle will unwind bobbin thread and pull it upwardly into an appropriate location within the material whereby a lock stitch will be formed in the material. This stitch forming sequence will continuously pull thread from the bobbin as well as from the needle spool.

Prior art sewing machines normally employ a take-up lever through which the needle thread passes. Upon the upward movement of the needle, the take-up lever moves upwardly in a more rapid manner than the needle eye to pull tight the interlocked threads which form the stitch. Following the formation of the stitch, the take-up lever moves downwardly to make available to the needle eye an excess of needle thread for the following stitch. The takeup lever, however, is normally of a limited length to minimize vibrations to the sewing machine which might otherwise cause unacceptable irregularities in the formed stitches. Because of this limitation on length, take-up levers are limited in the size of a loop they could withdraw while tightening a stitch. This size limitation, in turn, limits the size of the bobbin. As a result, the conventional smaller bobbins require the frequent replenishing of the bobbin thread. This, in turn, requires the frequent interruption of the sewing process for bobbin thread replenishment. The present invention allows for the elimination of take-up levers and associated needle thread controlling devices, such as tensioning mechanisms.

Figure 2:
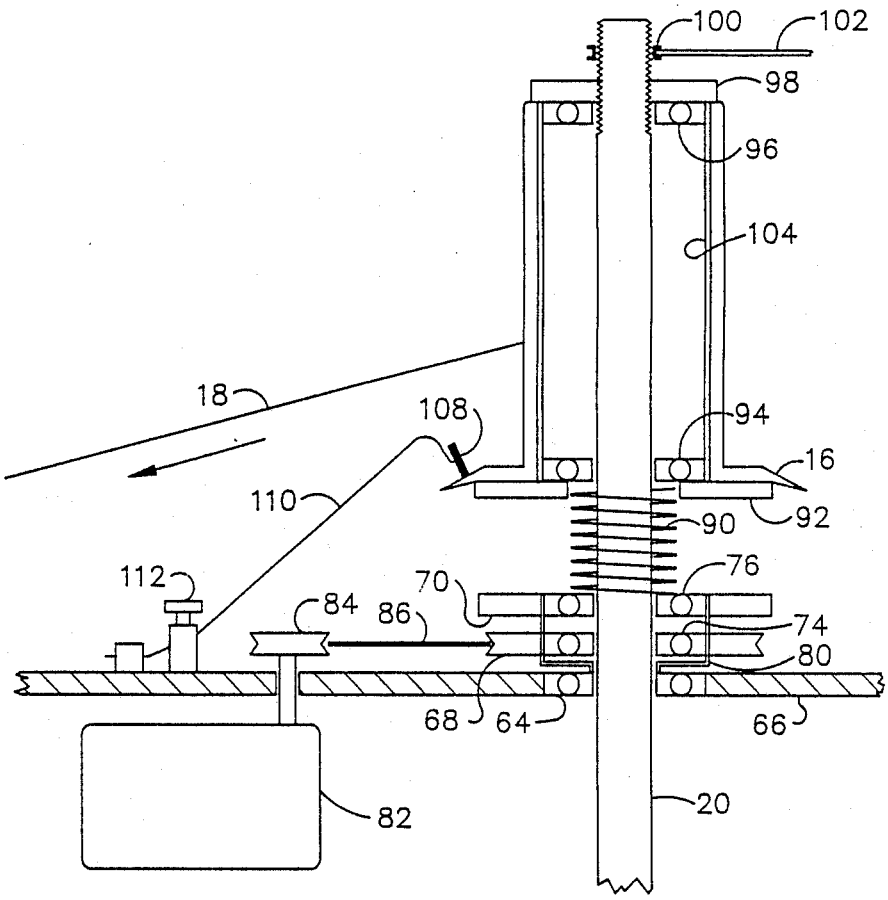
FIG. 2 is an enlarged sectional view of the needle thread spool and related mechanisms illustrated in FIG. 1.

As seen in FIG. 2, the needle thread 18 is located on a vertically disposed drive rod 20 at the top of the machine. The drive rod is adapted for oscillation along its axis. The axial oscillation of the drive rod is imparted by a pivoting arm 46 journaled on a short shaft 48 for oscillation beneath the drive rod. A first or horizontal ear 50 on the arm 46 includes a clevis 52 for receiving a radial pin 54 extending from the lower end of the drive rod 20. A second or vertical ear 56 is rotationally pinned to a connecting rod 60 with the opposite end of the connecting rod rotationally pinned to an ear 62 extending from the oscillating bobbin 40. As a result, oscillation of the bobbin in the conventional manner will axially oscillate the connecting rod 60 in synchronism with the bobbin 40 as well as with the needle 26 through the action of the drive train 36.

The drive rod 20 extends vertically upwardly through a bearing assembly 64, the outer race of which is secured to an aperture in the machine frame 66. A driven pulley 68 and a drive plate 70 are secured to the outer races of bearing assemblies 74 and 76 through the upper cylindrical portion of support member 80. The support member 80 has a lower cylindrical portion of a reduced diameter secured to the inner race of bearing assembly 64. The support member 80 thus couples the driven pulley 68, drive plate 70 and inner race of bearing assembly 64 for concurrent rotation. The inner races of the bearing assemblies 64, 74 and 76 are of such a diameter so as to allow the drive rod 20 to axially reciprocate without interfering with the rotation of the bearing assemblies. The bearing assembly 64, having its outer race secured to the fixed frame 66 of the sewing machine, thus supports the driven pulley 68 and drive plate 70 in spaced parallel planes through the support member 80 regardless of the axial position of the reciprocating drive rod 20. A second motor 82 is provided with a drive pulley 84 for driving the driven pulley 68 at a constant speed through a belt 86. The second motor thus drives the drive pulley, belt, driven pulley and drive plate at a speed and with a force independent of the speed of operation of the sewing machine.

Located above the drive plate 70, axially positioned on the drive rod 20, are a coil spring 90, a wear plate 92, a pair of bearing assemblies 94 and 96, a tensioning nut 98 and a bushing 100. The bushing 100 is slidingly received on the drive rod 20 and adapted to be located adjacent the top end of the drive rod 20 whereby a securing post assembly 102 may fixedly hold the top of the drive rod against bending displacement which may occur from the force of thread being pulled from the spool. The bushing 100 and assembly 102 may not be required if rod 20 has sufficient stiffness.

The two bearing assemblies 94 and 96 have their inner races slidingly fit onto the drive rod 20 to allow for axial movement of the needle thread spool 16. Their outer races are secured to the central bore of the spool 16 through an intermediate cylindrical sleeve 104. Preferably, the outer races of the bearing assemblies 94 and 96 are press fit into the sleeve 104 while the spool tightly fits onto the sleeve 104. The lower edge of the sleeve 104 is secured to the wear plate 92. The bearing assemblies 94 and 96 along with the sleeve 104, spool 16 and wear plate 92 thus constitute a slidable subassembly. This arrangement allows for the withdrawing of thread from the spool independent of the movement of the drive rod 20. It also allows for the removal of the spool 16 when depleted and its replacement with a new, full spool. The adjusting nut 98 is received on threads near the upper end of the drive rod and is screwed downwardly in contact with the bearing assembly 96 and spool 16 to establish a desired spacing between wear plate 92 and drive plate 70 and properly tension spring 90. The adjusting nut 98 also insures that the spool 16 will move downwardly with the drive rod 20 in response to the movement of the bobbin 40, connecting rod 60 and arm 46.

The upper portion of coil spring 90 contacts bearing assembly 94 and its lower portion contacts bearing assembly 76. The coil spring 90 thus tends to separate the drive plate 70 and the wear plate 92. A limited amount of mechanical frictional forces may be generated by the upper and lower faces of the spring as they contact the adjacent bearing assemblies. However, these frictional forces (which would tend to rewind the needle thread onto the spool in a direction opposite from the direction of spool rotation caused by the needle thread being pulled from the spool) are primarily dissipated through the bearings 94 and 76 by virtue of the spring 90 being seated against the inner races of the bearings. It has been found that a restrictive and adjustable force is preferably provided to the spool through a bearing 108 rotatably mounted on the free end of a leaf spring 110. The leaf spring is secured at its opposite end to the frame of the machine 10 through an adjusting bolt 112 so as to allow for the adjustment of the force tending to restrict the motion of the needle thread as it is pulled from its spool.

The withdrawal of the needle thread away from the bobbin occurs as the bobbin approaches the needle thread loop. During this motion of the bobbin 40, the connecting rod 60 moves to oscillate the arm 46 whereby the clevis 52 will move the drive rod 20 downwardly. When, however, the needle and bobbin have coupled their threads and begin to move away from each other, the coil spring 90 will be compressed sufficiently to allow the wear plate 92 to contact the drive plate 70 and thereby drive the wear plate, spool, and needle thread in a thread rewinding direction, the direction opposite from the direction of the arrow of FIG. 2. The wear plate 92 is axially displaced from the bearing assembly 94 a sufficient distance to provide a space into which the compressed coil spring may fit to thereby allow the frictional coupling of the adjacent surfaces of the drive plate and wear plate. The rewinding of the needle thread onto the spool results in the tightening of the needle thread in the area of the stitch to shorten the loop whereby a tight lock stitch is formed in the material. By properly adjusting the connecting rod 60, drive rod 20, and adjusting nut 98, the needle thread station 12 may retract virtually any amount of thread from the stitch forming station 14 which allows for the accommodation of larger bobbins than was ever possible previously. The benefits of larger bobbins with greater amounts of bobbin thread allow for greater sewing time and efficiencies since the periodic bobbin replenishing step is reduced significantly. This benefit is derived in addition to the benefit of optimumly tightened stitches. Further, there is no longer any need to adjust a thread tensioning mechanism as previously employed in prior art devices.

Figure 3:
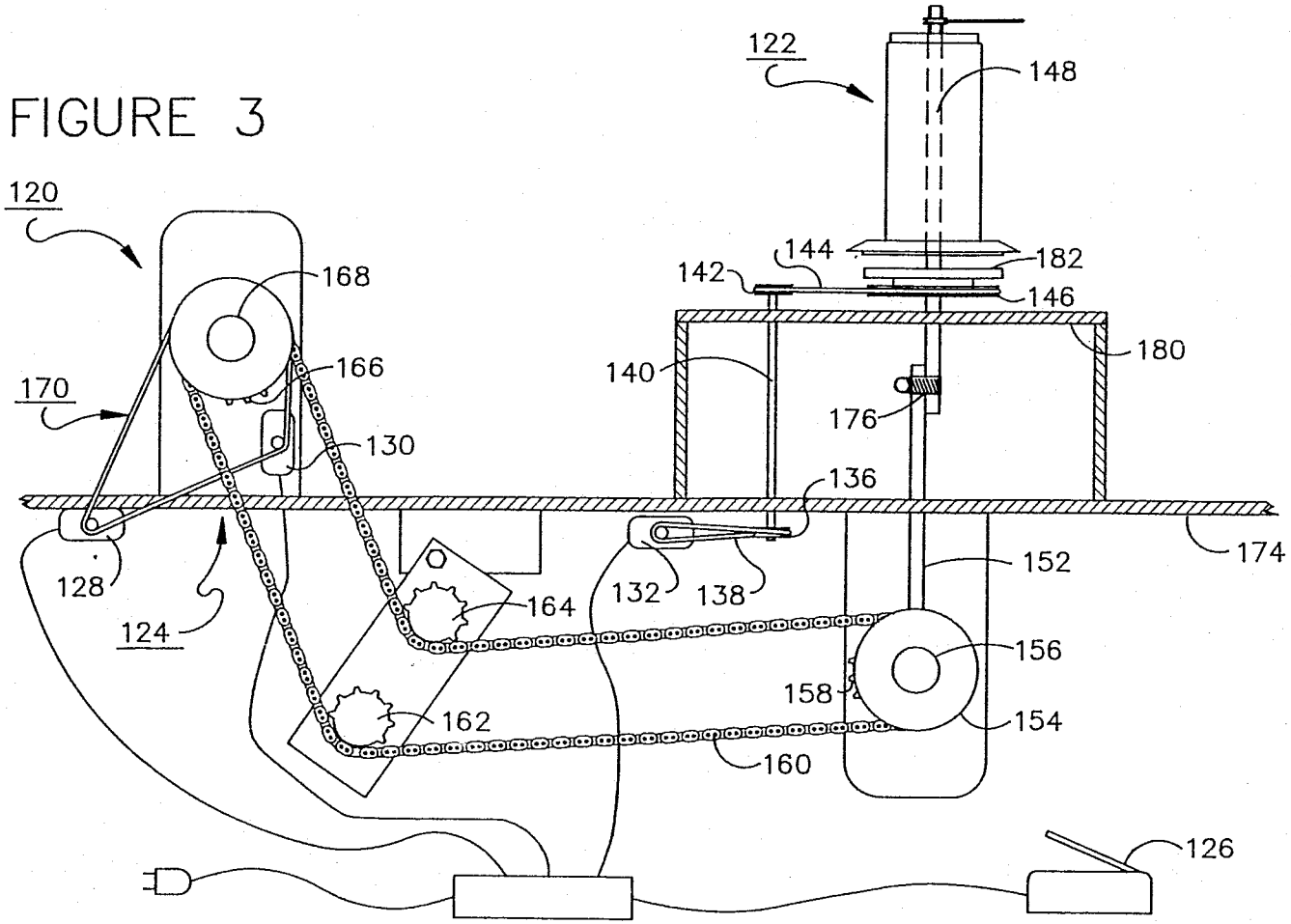
FIG. 3 is a sectional view of portions of an alternate embodiment of a sewing machine also constructed in accordance with the principles of the present invention and which is also adapted for carrying out the method of the present invention.
Figure 6:
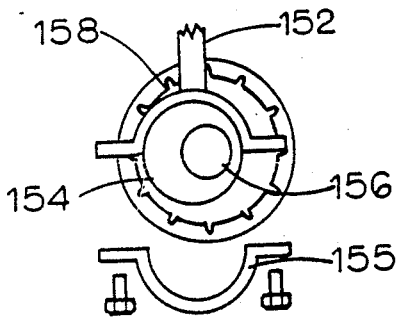
FIG. 6 is a view of the reverse side of the sprocket drive showing the cam drive for the spool.

In an alternate embodiment of the invention, that shown in FIGS. 3, 4 and 5, the sewing machine 120 includes a needle thread station 122 located more remote from the stitch forming station 124. This arrangement is frequently employed in commercial, rather than domestic, sewing machines. According to this alternate embodiment, the operator controls the foot switch 126 for driving a plurality of motors 128, 130 and 132 for energizing various parts of the machine. One such motor 132 is the attachment motor for thread rewinding. This additional motor drives a first pulley 136 through a belt 138 to rotate a first shaft 140 which, in turn, drives a second pulley 142, belt 144 and third or driven pulley 146. The driven pulley 146 drives a driven plate with bearing assemblies, support member, etc. in a manner similar to that as described above with respect to the primary embodiment. Vertical reciprocation of the drive rod along its axis is effected through a vertical cam follower rod 152. The lower end of the cam follower rod rides on a cam 154 mounted for rotation on a short shaft 156. FIG. 6 shows a reverse view of the sprocket drive illustrating the cam 154. A bracket 155 attaches rod 152 to cam 154. The short shaft also supports a driven gear 158. The driven gear is coupled, through a chain 160 and sprockets 162 and 164, to a gear 166 on the main drive shaft 168 of the machine 120 which, through a drive train assembly 170, moves the needle and bobbin in synchronism with the cam. The cam follower rod 152 extends through a base plate 174 of the machine 120 and has at its upper end a bracket 176. The bracket 176 receives the drive rod 148 whereby the axial movement of the bracket 176 will result in axial reciprocation of the drive rod. In this manner the drive rod may reciprocate axially through the rotation of the cam 154 and axial reciprocation of the follower rod 152 and bracket 176. The axial movement of the drive rod 148 downwardly will cause the downward movement of the wear plate 186 and the frictional coupling of its lower surface with the upper surface of the drive plate 182. With the upper surface of the wear plate 186 secured to the lower surface of the spool holder 196, this movement of the drive rod 148 will also effect the desired reverse rotation of the spool and the rewinding of the needle spool thread in synchronism with the movement of the drive rod, needle and bobbin, all as intended.

The external appearance of the needle thread station in the alternate embodiment is essentially the same as that of the primary embodiment. It includes a fixed frame 180, driven pulley 146, drive plate 182, wear plate 186, adjusting nut 188 and bushing 190 identical with those of the primary embodiment. In accordance with the alternate embodiment, however, the ball bearing assemblies within the spool and the coil spring are no longer utilized. Instead, the spool 192 is constructed with a rectangular aperture adapted to receive a spool holder 196 having a corresponding rectangular exterior cross sectional configuration. A central cylindrical bore extends through the spool holder and is adapted to loosely fit over the cylindrical drive rod 148. The bore of the spool holder is of such a size as to freely rotate with respect to the drive rod. When the spool holder is rotated in either direction, however, it will rotate the spool concurrently therewith due to their corresponding cross sectional configurations.

Coupling between the spool holder and drive rod is effected through a pair of thrust bearing assemblies 198 and 200 located with their inner races in contact with the drive rod and with their outer races secured to the spool holder 196 through recesses in the upper and lower surfaces of the spool holder. The thrust bearing assemblies are conventional in their construction, operation and use to increase in their resistance to rotate as axial force is applied as through the adjusting nut 188. The thrust bearing assemblies are supported in association with the drive rod and the spool holder whereby tightening of the adjusting nut will apply an axial force to the thrust bearing assemblies to increase the frictional coupling between the drive rod and the spool holder. In this manner, the adjusting nut may be rotated to provide an increased or decreased resistive force to the needle pulling thread from the spool. Lastly, a securing post assembly 204 and bushing 190 may be employed to provide a rigidity to the upper portion of the drive rod as in the primary embodiment.

By this construction of the alternate embodiment, an additional benefit is derived during the replacement of the needle thread spool. Since no bearing assembly is employed to couple the spool to any other part of the assembly, the time to press fit the bearing races onto their associated supporting surfaces as required in the primary embodiment is eliminated. The second embodiment merely requires the removal of the bushing 190. The needle thread may then be replenished by lifting of the depleted spool and dropping on a new one over the spool holder. The bushing 190 would then be placed in position to complete the needle thread station.

In performing the method of the present invention, a stitch would be made through the conventional steps plus the addition of the periodic rewinding of the needle thread onto its spool 16 or 192, all in an optimum sequence, for optimum amounts for thread dispensing and rewinding to make optimum stitches, time after time, and requiring minimized training of, and adjustment by, an operator.

The method of forming lock stitches with the above described sewing machine is essentially the same for both embodiments. The reciprocating needle pulls needle thread from its spool and inserts it through the material to be stitched. The needle forms a loop of needle thread beneath the material to be stitched. The bobbin with bobbin thread is then passed through the loop. The needle is then withdrawn from the material at which time the needle thread pulls off bobbin thread from the bobbin for the forming of a lock stitch. A portion of the needle thread is then rewound onto its spool as the needle pulls off bobbin thread from the bobbin so as to form tight lock stitches. The rewinding step includes the intermittent frictional coupling of the wear plate 92 or 186 and the continuously rotating drive plate 70 or 182 which is effected by the axial movement of the wear plate into contact with the drive plate. The rewinding step is done intermittently, in synchronism with the stitch forming movements of the needle and the bobbin. The rewinding of the spool is initiated after the bobbin has passed through the loop and the needle has begun its ascent while the terminating of the rewinding of the spool occurs prior to the bobbin passing through the loop and the needle beginning its descent.

The present disclosure includes that information contained in the appended claims as well as that in the foregoing description. Although the invention has been described in its preferred embodiments with a certain degree of particularity, it is understood that numerous changes in the details of construction, fabrication and use, including the combination and arrangement of parts and method steps, may be made without departing from the spirit and scope of the invention.

What is claimed is:

1. A method of forming lock stitches with a sewing machine wherein a reciprocating needle pulls needle thread from a spool and inserts the thread through a material to be stitched to form a loop of needle thread, and wherein bobbin thread is passed through the loop, and wherein the needle is withdrawn from the material to pull off bobbin thread from a bobbin for the forming of a lock stitch, the method comprising the step of rewinding needle thread onto the spool as the needle pulls off bobbin thread from the bobbin so as to form a tight lock stitch.

2. The method as set forth in claim 1 wherein the rewinding step includes intermittently frictionally coupling a rotatable wear plate coupled to the spool and a continuously rotating drive plate.

3. The method as set forth in claim 2 wherein the step of frictionally coupling includes moving the wear plate into contact with the drive plate against the force of a coil spring.

4. The method as set forth in claim 1 wherein the rewinding step comprises intermittently rewinding the needle thread in synchronism with the stitch forming movements of the needle and the bobbin and further including the steps of:

initiating the rewinding of the needle thread after the bobbin has passed through the loop and the needle has begun its ascent; and terminating the rewinding of the needle thread prior to the bobbin thread passing through the loop and the needle beginning its descent.

5. A sewing machine for forming lock stitches comprising a reciprocating needle for pulling needle thread from a spool and inserting the thread through a material to be stitched to form a loop of needle thread, a bobbin for supporting a supply of bobbin thread to be passed through the loop, drive means to withdraw the needle from the material and thereby pull off bobbin thread from the bobbin for forming of lock stitches and rewinding means for rewinding needle thread onto the spool as the needle pulls off bobbin thread from the bobbin so as to form a tight lock stitch.

6. The apparatus as set forth in claim 5 wherein said rewinding means includes a rotatable wear plate coupled to the spool and a continuously rotating drive plate positioned for rotation in a plane parallel to a plate of said wear plate, and means for intermittently frictionally coupling said wear plate and said drive plate in synchronism with the movement of the needle and rotation of the bobbin.

7. The apparatus as set forth in claim 6 wherein said frictionally coupling means includes a drive rod supporting the spool and said wear plate and passing through said drive plate, a spring positioned about said rod between said wear plate and said drive plate for biasing said wear plate away from said drive plate, and means for axially displacing said rod in inverse synchronism with the needle for moving said wear plate into momentary engagement with said drive plate for effecting partial reverse rotation of the spool for rewinding excess thread for pulling the lock stitch tight.

8. The apparatus as set forth in claim 5 and including:

means for actuating said rewinding means intermittently in synchronism with the stitch forming movements of the needle and the bobbin after the bobbin has passed through the loop and the needle has begun its ascent; and means for terminating operation of said rewinding means prior to the bobbin thread through the loop and the needle beginning its descent.

9. A sewing machine for forming lock stitches from a needle thread and a bobbin thread comprising:

a spool for supporting a supply of needle thread;

a needle reciprocable upwardly and downwardly to pull needle thread from said spool and insert it through a material to be stitched when the needle is driven downwardly for forming a loop of needle thread below the material;

a bobbin for supporting a supply of bobbin thread, said bobbin being movable in a path of travel to pass bobbin thread through the loop;

drive means for moving the needle and bobbin in synchronism whereby the needle pulls bobbin thread when the needle is driven upwardly following passage of the bobbin thread through the loop to thereby form a lock stitch; and rewinding means for rewinding needle thread onto said spool as the needle is driven upwardly for pulling a predetermined tension on the needle thread for forming a tight lock stitch.

10. The sewing machine as set forth in claim 9 wherein said rewinding means includes a drive rod supporting said spool, a wear plate attached to and rotatable with said spool, a drive plate continuously rotatable about said drive rod adjacent said wear plate, and means for intermittently frictionally coupling said wear plate and said drive plate by axially displacing said rod.

11. The sewing machine as set forth in claim 10 and further including means coupling said spool for rotation about said drive rod.

12. The sewing machine as set forth in claim 11 and further including means for establishing a predetermined frictional rotation retarding force on said spool.

13. The sewing machine as set forth in claim 12 and including a spool holder having an inner bore for slidably receiving said drive rod, said spool holder having an outer rectangular cross sectional configuration, said spool having a rectangular cross sectional inner bore for fitting over said spool holder, and bearing means positioned in said spool holder inner bore for permitting rotation of said spool holder and spool about said drive rod.

14. The sewing machine as set forth in claim 13 wherein said bearing means comprise thrust bearing for frictionally coupling said drive rod to said spool holder.

* * * * *